US005528104A

United States Patent [19]

Kim et al.

[11] Patent Number: 5,528,104

[45] Date of Patent: Jun. 18, 1996

[54] METAL HALIDE LAMP WITH PLEATED LUMINOUS TUBE ENVELOPE

[75] Inventors: Dong-ha Kim, Suwon; Seong-ho Lee, Taejeon, both of Rep. of Korea; Ikuo Iwai, Himeji, Japan

[73] Assignee: Samsung Display Devices Co., Ltd., Kyungki-do, Rep. of Korea

[21] Appl. No.: 227,142

[22] Filed: Apr. 13, 1994

[30] Foreign Application Priority Data

Sep. 24, 1993 [KR] Rep. of Korea ..... 93-19671

[51] Int. Cl.[6] ..... H01J 61/33

[52] U.S. Cl. ..... 313/573; 313/634; 220/2.1 R; 315/50

[58] Field of Search ..... 315/50, 32; 313/634, 313/110, 573, 44, 45, 46; 220/2.1 R

[56] References Cited

U.S. PATENT DOCUMENTS

| | | | |
|---|---|---|---|
| 3,885,181 | 5/1975 | Nelson et al. | 313/634 X |
| 4,260,931 | 4/1981 | Wesselink et al. | 313/493 |
| 4,438,373 | 3/1984 | Watanabe et al. | 315/334 |
| 5,055,740 | 10/1991 | Sules | 313/634 |
| 5,252,886 | 10/1993 | Renardus et al. | 313/634 X |

*Primary Examiner*—Robert Pascal
*Assistant Examiner*—Arnold Kinkead
*Attorney, Agent, or Firm*—Lowe, Price, LeBlanc & Becker

[57] ABSTRACT

A metal halide lamp includes a luminous tube which is sealed and filled with predetermined rare gases and metal halide, a pair of electrodes provided in the inner portion near both ends of the luminous tube, an outer tube which encloses the luminous tube, and a pair of socket connectors electrically connected with the electrodes, wherein the luminous tube cross-section forms an uneven pattern and is pleated along outer and inner surfaces of the luminous tube. The atmospheric pressure in the luminous tube is stabilized to prevent the bending of the arc. Accordingly, the lifetime of the luminous tube is prolonged and high vapor density is obtained, thereby improving luminous efficiency and color rendering by far.

5 Claims, 2 Drawing Sheets

METAL HALIDE LAMP WITH PLEATED LUMINOUS TUBE ENVELOPE

BACKGROUND OF THE INVENTION

The present invention relates to a metal halide lamp (hereinafter, referred to as an MHL) and more particularly, to an MHL capable of improving luminous efficiency and color rendering by improving the structure of a luminous tube.

Generally, lighting lamps of high brightness and long life are installed street light fixtures and industrial work areas. Among such commercially available lamps, there are a high pressurized mercury lamp, a high pressurized sodium lamp and a MHL. The mercury lamps are the most widely used, and their lifetime is comparatively long. However, their luminous efficiency is not so good and their luminous color feels chilly and cold. The sodium lamps are best in view of the luminous efficiency but their color rendering characteristic is not so good. However, the MHL is better than the mercury lamp in view of the luminous efficiency, and is best in view of the color rendering. Accordingly, the use of the MHL style is becoming more and more widespread. The cost of the MHL, however, is slightly high in cost but should be solved in the near future. Together with the increase of use of the MHL, some prerequisites to be met follow naturally. Particularly, in the field of the interior decoration in which the illumination effects play an important role, such prerequisites should be satisfied with carefulness. Particularly, a small MHL which is used in the field of interior decoration should have low power consumption, high efficiency, high color rendering and a long lifetime. Here, the MHL which is chiefly used in an interior room will be described below.

In FIG. 1, one example of a horizontal start type MHL is shown among the above conventional MHLs. Referring to FIG. 1, in an oval crystal luminous tube 1 are opposedly provided a pair of electrodes 2*a* and 2*b*. In each electrode is formed a zirconia temperature-keeping layer 3. Also, in the space of luminous tube 1 are sealed and filled with predetermined rare gases, mercury and metal halide. An outer tube encloses luminous tube 1 and its accessories. The inner portion of outer tube 4 is sealed and filled with nitrogen and inert gases. Socket connectors 5 are provided in both sides of outer tube 4, and are electrically connected with electrodes 2*a* and 2*b*. Here, a reference numeral 6 represents a getter which absorbs the remaining gas and increases the vacuum.

FIG. 2 shows a conventional partly extracted luminous tube of the lamp shown in FIG. 1. Referring to FIG. 2, luminous tube 1 has an oval shape, at both ends on the long axis of which are provided electrodes 2*a* and 2*b*. From each electrode is drawn out a lead wire W. Particularly, as shown in FIG. 2, between the lead wire and the lead wire is installed a molybdenum thin plate M for maintaining a gas-tight seal, thereby connecting the lead wires. Also, as described above, on either electrode is formed temperature-keeping layer 3, which prevents the lowering of the temperature in both electrodes. On the other hand, an arch portion represented by dotted curved lines which is located between the electrodes shows an upward bending phenomenon of an arc generated due to the inner temperature difference in the luminous tube during the illumination to be described later.

FIG. 3 is a cross-sectional view of the luminous tube shown in FIG. 2, cut along line III—III. As shown in FIG. 3, the cross-section of luminous tube 1 has a cylindrical shape having a predetermined thickness. Due to the temperature difference by generation of the minimum-temperature portion during the illumination of the luminous tube to be described later, the arc is bent upwards by the bending phenomenon.

By the way, in such a conventional MHL of the above structure, if a state of the lamp is investigated during the illumination, the lower end of luminous tube 1 is cooled by a convection phenomenon of the gas in luminous tube 1 and becomes a relative minimum-temperature portion. Also, by the temperature difference due to such a convection, the arc is bent upwards. Accordingly, crystal luminous tube 1 is degraded by non-uniform local heating. On the other hand, the vapor pressure of the metal halide is varied depending upon the temperature of the minimum-temperature portion. Accordingly, condensation of the compound is generated by the cooling action in the lower end of the luminous tube, as a result that the sufficient vapor pressure is not formed. As a result, the efficiency of the lamp is lowered.

SUMMARY OF THE INVENTION

Therefore, to solve the above problems, it is an object of the present invention to provide a metal halide lamp capable of improving luminous efficiency and color rendering by improving the structure of a luminous tube.

To accomplish the above object of the present invention, there is provided a metal halide lamp comprising:

a luminous tube which is sealed and filled with predetermined rare gases and metal halide;

a pair of electrodes provided in the inner portion of both ends of the luminous tube;

an outer tube which encloses the luminous tube; and a pair of socket connectors electrically connected with the electrodes, wherein the luminous tube whose cross-section forms an uneven pattern and is pleated along the outer and inner surfaces of the luminous tube.

The present invention having the above composition refracts again the light inward or irregularly reflects the light to a large extent, with respect to the light which is externally transmitted from the luminous tube, thereby improving luminous efficiency and color rendering by far.

BRIEF DESCRIPTION OF THE DRAWINGS

The above objects and advantages of the present invention will become more apparent by describing in detail a preferred embodiment of the present invention with reference to the attached drawings in which.

DETAILED DESCRIPTION OF THE INVENTION

Figure 1:
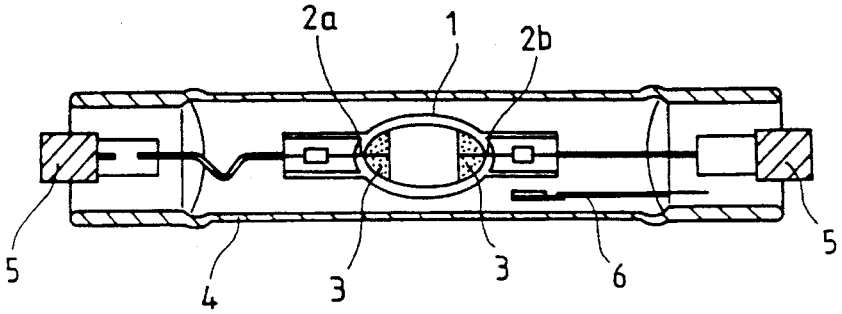
FIG.1(PRIOR ART)
FIG. 1 shows an example of a conventional metal halide lamp.
Figure 2:
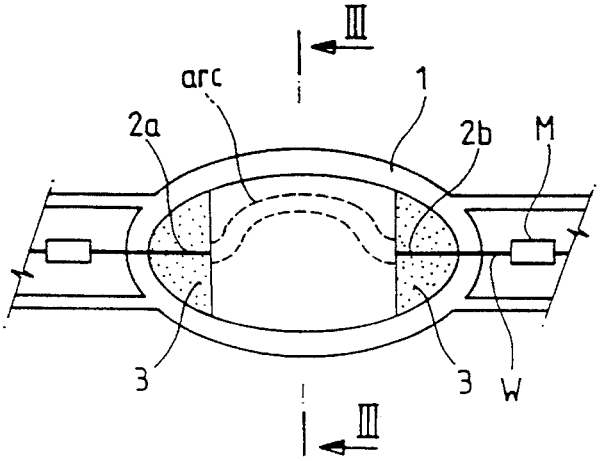
FIG.2(PRIOR ART)
FIG. 2 is a partly extracted view of the conventional luminous tube of the lamp shown in FIG. 1.
Figure 3:
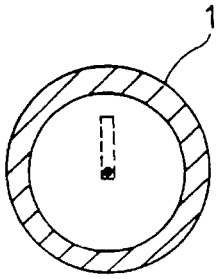
FIG.3(PRIOR ART)
FIG. 3 is a cross-sectional view of the luminous tube shown in FIG. 2, cut along a line III—III.
Figure 4:
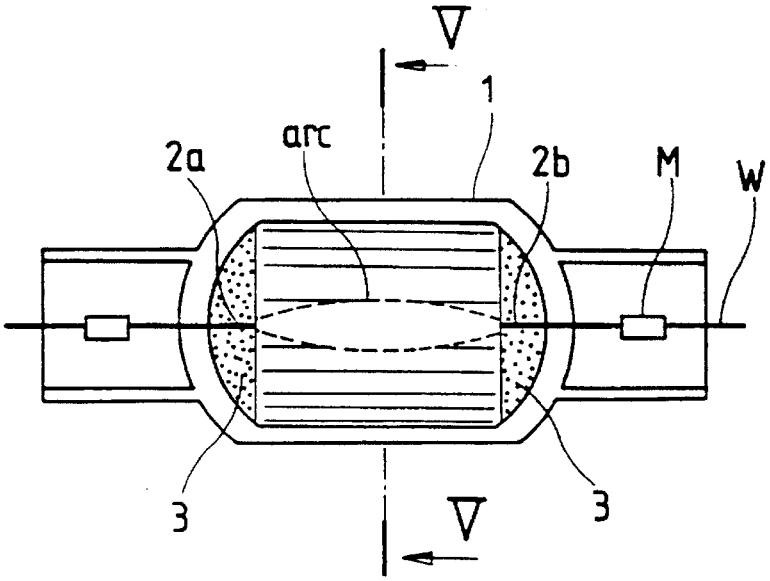
FIG. 4 is a partly extracted view of a luminous tube of a metal halide lamp according to the present invention.
Figure 5:
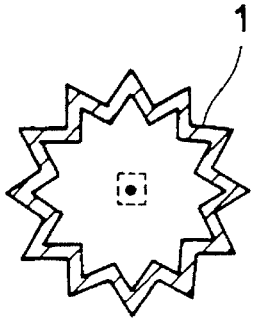
FIG. 5 is a cross-sectional view of the luminous tube shown in FIG. 4, cut along a line V—V.

In FIG. 4, the overall shape of luminous tube 1 is cylindrical. The body of luminous tube 1 is shown in FIG. 5 as a cross-section cut along the short axis direction (a line V—V) and is formed of a sawtooth unevenness portion which is the feature of the present invention. Here, such an unevenness portion can be formed parallel to the center axis in the lengthwise direction of the luminance tube as shown in FIG. 4. Also, the unevenness portion may be formed diagonally or vertically with respect to the center axis line, or as a wave pattern. The uneven surfaces refract internally the light to a large extent of the light which is externally transmitted from the tube, differently from the conventional cylindrical surface, and irregularly reflects the light due to the arc. Accordingly, the temperature of the arc inner center portion is increased, thereby expediting the vaporization of the metal halide which is condensed in a minimum-temperature portion formed in the bottom of luminous tube 1. Such active vaporization of the metal halide further improves luminous efficiency and color rendering. Also, a pair of electrodes 2*a* and 2*b* are opposedly provided in luminous tube 1 at both the ends on the long axis line thereof. Around the electrodes are formed temperature-keeping layers 3. Lead wire W is drawn out from each electrode. Between the lead wires are molybdenum thin plate M in order to mutually connect the lead wires. On the other hand, a portion which is represented as dotted lines on a long axis line between the electrodes shows the shape of an arc formed by stabilization of the inner atmospheric pressure at the illumination operation state of the lamp according to the present invention.

FIG. 5 is a cross-sectional view of the luminous tube shown in FIG. 4, cut along a line V—V. As shown in FIG. 5, the body of luminous tube 1 is formed of sawtooth-shaped unevenness portion. As described above, such a shape irregularly refracts again the light inward to a great extent with respect to the light which is externally transmitted from the tube. Accordingly, the temperature of the inner center in the tube maintains a high temperature state. Thus, since the temperature of the minimum-temperature portion is increased, the vapor density of the sealed and filled metal halide maintains sufficient high density, thereby far more improving luminous efficiency and color rendering.

As described above, the metal halide lamp according to the present invention has an excellent luminous efficiency and color rendering since the body of the luminous tube is formed of the pleated unevenness portions. Accordingly, in case of the interior lamps and the various industrial fields, the work efficiency and productivity is greatly increased.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A metal halide lamp comprising:

a luminous tube having an inner portion and being sealed and filled with predetermined rare gases and metal halide;

a pair of electrodes provided in the inner portion near both ends of the luminous tube;

an outer tube which encloses the luminous tube; and a pair of socket connectors electrically connected with the electrodes, wherein the luminous tube has a cross-section which forms an uneven pattern and is pleated along outer and inner circumferential surfaces thereof.

2. A metal halide lamp as claimed in claim 1, wherein said uneven pattern has a V-shaped form, and plurality of channels are formed to be parallel in the longitudinal direction of said luminous tube on the inner and outer circumferential surfaces thereof.

3. A metal halide lamp as claimed in claim 1, wherein said uneven pattern has a sawtooth form, and a plurality of channels are formed diagonally with respect to the length of said luminous tube.

4. A metal halide lamp as claimed in claim 1, wherein said uneven pattern has a sawtooth form, and a plurality of channels are formed vertically with respect to the length of said luminous tube.

5. A metal halide lamp as claimed in claim 1, wherein said uneven pattern has a sawtooth form, and a plurality of channels are formed as a wave pattern.

* * * * *